US009194212B2

(12) United States Patent
Gaskin et al.

(10) Patent No.: US 9,194,212 B2
(45) Date of Patent: Nov. 24, 2015

(54) ACTUATOR AND METHOD

(75) Inventors: Keith Gaskin, Aberdeen (GB); George Clark, Aberdeen (GB); Darren Chapman, Aberdeen (GB)

(73) Assignee: CFF Technologies Limited, Aberdeen (GB)

( * ) Notice: Subject to any disclaimer, the term of this patent is extended or adjusted under 35 U.S.C. 154(b) by 895 days.

(21) Appl. No.: 13/390,419

(22) PCT Filed: Aug. 11, 2010

(86) PCT No.: PCT/GB2010/051327

§ 371 (c)(1),
(2), (4) Date: Apr. 27, 2012

(87) PCT Pub. No.: WO2011/018659

PCT Pub. Date: Feb. 17, 2011

(65) Prior Publication Data

US 2012/0199366 A1 Aug. 9, 2012

(30) Foreign Application Priority Data

Aug. 14, 2009 (GB) ..... 0914258.9

(51) Int. Cl.

| | |
|---|---|
| ***E21B 34/06*** | (2006.01) |
| ***E21B 7/00*** | (2006.01) |
| ***E21B 34/00*** | (2006.01) |
| ***E21B 34/14*** | (2006.01) |
| ***E21B 10/32*** | (2006.01) |

(52) U.S. Cl.
CPC ..... *E21B 34/14* (2013.01); *E21B 10/32* (2013.01)

(58) Field of Classification Search
CPC ..... E21B 34/10; E21B 7/28; E21B 10/32; E21B 34/12; E21B 34/00; F16K 31/00; F16K 31/12
USPC ..... 166/373, 321, 332.2; 175/57, 107, 322; 251/315.16, 56, 63.6; 415/13, 36, 25
See application file for complete search history.

(56) References Cited

U.S. PATENT DOCUMENTS

| | | | | |
|---|---|---|---|---|
| 2,879,032 A | | 3/1959 | Whittle | |
| 3,504,750 A | * | 4/1970 | Rouviere et al. | 175/244 |
| 4,580,519 A | * | 4/1986 | Brewer | 116/34 R |

(Continued)

FOREIGN PATENT DOCUMENTS

GB 2183272 A 6/1987

OTHER PUBLICATIONS

Strommen, Henrick, "International Search Report", for PCT/GB2010/051327 as mailed Nov. 3, 2010, 3 pages.

*Primary Examiner* — Kenneth L Thompson
*Assistant Examiner* — Michael Wills, III
(74) *Attorney, Agent, or Firm* — Winstead PC

(57) ABSTRACT

A downhole actuator or valve for inclusion in a downhole drill string used in a well includes an obstructing member, such as a piston, moveable between: a first position and a second position; and a retaining member, such as a ball, moveable between: a retaining position which retains the obstructing member in the first position; and, a release position which does not retain the obstructing member in the first position and/or allows or causes the obstructing member to move to the second position. The retaining member is moved in use between the retaining position and release position at least in part by centrifugal forces caused by rotation of the entire drill string within which the downhole actuator/valve is included. Thus, at least some control of the actuation of the downhole actuator/valve may be afforded by rotation thereof.

34 Claims, 11 Drawing Sheets

(56) References Cited

U.S. PATENT DOCUMENTS 4,721,172 A * 1/1988 Brett et al. ..... 175/26
6,854,953 B2 * 2/2005 Van Drentham-Susman et al. ..... 415/36
2003/0029308 A1 2/2003 Van Drentham-Susman et al.

* cited by examiner

ACTUATOR AND METHOD

BACKGROUND

This invention relates to an actuator and more particularly to a valve and a method to control the actuator/valve, especially for use downhole.

Downhole actuators and valves may be used for a number of different downhole operations but require a control mechanism in order to control the valve. Such control mechanisms during drilling or certain other operations, such as coring or fracturing, are difficult to provide. For example, during drilling a borehole, the drill bit is normally mounted on a drill stem or string, which is rotated from the surface. Controlling a valve on such a drill string poses obvious problems.

In certain situations, the borehole may require to be reamed, that is the diameter thereof increased. This may be achieved through simply using a larger drill bit, but this is inefficient at best since only a lower section of the borehole is required to be of the larger diameter. In other situations the upper section of the borehole may already be cased with a tubular string having a narrower diameter than that required below the casing and so it is not possible to use such a larger drill bit. Thus to drill or ream such boreholes, retractable blades are attached to the outside of the drill string. The blades are retracted and then sent down the narrower upper section of the borehole, activated by a valve to extend outwards, and then used to ream the lower section of the borehole.

The activation of such a reamer is often done by a drop ball valve. A ball is dropped onto a ball seat provided on the valve which blocks flow therebelow. The pressure above the ball/ball seat is increased and this pressure may be used to activate the reamer and cause its blades to pivot outwards.

However, the drop ball method may not always be possible since there may not be a clear passage to the reamer—other intervening equipment, such as a filter, can block this passage. Moreover, there is often no way to recover the ball after use and so retracting the reamer's blades is difficult. Furthermore, it is difficult to cycle such a system with drop ball methods and therefore the string has to be pulled out of hole to be reset which can be a very costly and time consuming process.

SUMMARY

According to a first aspect of the present invention there is provided an actuator comprising:

an obstructing member moveable between:
- a first position and a second position; and a retaining member moveable between:
- a retaining position which retains the obstructing member in
- the first position; and,
- a release position which does not retain the obstructing member in the first position and/or allows or causes the obstructing member to move to the second position;

wherein the retaining member is adapted to move in use, from one of the retaining position and release position to the other of the retaining position and release position, at least in part, by centrifugal forces caused by rotation of the actuator.

Preferably, the actuator further comprises an inlet and an outlet and as such is preferably in the form of a valve. Preferably, in such a valve, the first position of the obstructing member is an obstructing position which obstructs at least one of the inlet and the outlet and the second position is an open position where such obstruction is reduced.

According to a second aspect of the present invention there is provided a valve comprising:

an inlet and an outlet;

an obstructing member moveable between:
- an obstructing position which obstructs at least one of the inlet and the outlet; and
- an open position where said obstruction is reduced;

wherein the obstructing member is adapted to move in use from one of the obstructing position and open position to the other of the obstructing position and open position, at least in part, by centrifugal forces caused by rotation of the valve.

Thus the present invention provides an actuator and/or a valve which may be controlled by centrifugal forces, thus allowing convenient operation in, for example, downhole environments. Preferably therefore, the actuator is a downhole actuator and typically the valve is a downhole valve.

The in-use centrifugal forces may directly move the obstructing member from one of the said positions to the other, but preferably the obstructing member is adapted to move from one position to the other by indirect means.

Preferably therefore, the valve comprises:

a retaining member moveable between:
- a retaining position which retains the obstructing member in one of said obstructing position and said open position; and,
- a release position which does not retain the obstructing member in said position;

wherein the retaining member is adapted to move in use, from the retaining position or release position to the other of the retaining position and release position, at least in part, directly by centrifugal forces caused by rotation of the valve.

Thus, the invention preferably provides an actuator and/or a valve where one member, the obstructing member, can selectively direct the flow of fluid, and another member, the retaining member, can aid positioning of the obstructing member.

Preferably, the centrifugal forces act directly on the retaining member to move it from one of said positions to the other.

Typically, the obstructing member may be moveable to a further intermediate position in which the retaining member is located in a predetermined location which may be a central location but in which the retaining member is not locked in that location and in which the retaining member could move to the release position.

The obstructing member normally obstructs, at least partially, the outlet. Preferably, there is a primary and a secondary outlet and the obstructing member obstructs only the secondary outlet. Thus when the obstructing member is in the obstructing position, fluid flows, in use, from the inlet to the primary outlet. When the obstructing member is in the open position fluid flows, in use, from the inlet to the secondary outlet, and normally to the primary outlet as well.

Preferably the obstructing member is arranged such that, in use, fluid flow urges the obstructing member towards a downwards position. Preferably the valve has a first biasing mechanism to bias the obstructing member towards an upwards position, that is typically opposite the direction urged by the fluid flow in use. This biasing mechanism may be achieved through a spring or tensile mechanism, preferably a spring mechanism.

A downwards direction is defined as a direction towards the retaining member which is typically, in use, a direction away from the surface, that is away from a start of the borehole.

An upwards direction is defined as a direction away from the retaining member which is typically, in use, a direction towards from the surface, that is towards the start of the borehole.

Thus the obstructing member in use can be in an upwards or a downwards position. For an individual embodiment, one of these upwards/downwards positions corresponds with said obstructing position and the other upwards/downwards position with said open position. However different embodiments can have the upward/downward positions corresponding with different obstructing/open positions. For example, in a first embodiment the obstructing position corresponds with the upward position and the open position corresponds with the downward position; and in a second embodiment, the obstructing position corresponds with the downward position and the open position corresponds with the upward position In preferred embodiments, the obstructing member comprises a piston provided in a cylinder. The obstructing member may further comprise a rod rigidly attached to the piston such that they move together.

Typically the retaining member is provided in a housing, through which the obstructing member, typically the rod of the obstructing member, extends. Typically the actuator/valve is arranged such that in use, a portion of the retaining member contacts a portion of the obstructing member, especially the rod, in order to retain the obstructing member in one of its two positions. Typically this occurs in the retaining position and preferably the upwards position and more preferably, whilst the obstructing member is maintained in the first or obstructing position, the obstructing member is adapted to prevent movement of the retaining member from the retaining position to the release position.

Preferably a lower face is provided which abuts with the retaining member, at least in the retaining position. Thus when in the retaining position, the retaining member is preferably retained between the lower face and the obstructing member.

For many embodiments, the lower face supports the retaining member.

The lower face may be part of the housing.

For certain embodiments an aperture may be provided in the lower face, typically to allow the rod to extend therethrough.

Preferably the retaining member comprises a ball. In alternative embodiments a lever may be pivotally mounted on the obstructing member. Moreover, retaining member(s) of various sizes may be used, for example by being mounted on springs.

For certain embodiments, the retaining member comprises a plurality of plates with circumferentially extending lips, such that the lips may retain the obstructing member in the upper position, whilst a portion of the plates abuts with the lower face.

Preferably one dimension of the housing is just slightly larger than the diameter of the retaining member that is preferably said dimension is less than two times the diameter of the retaining member, more preferably less than 1.5 times the diameter of the retaining member and even more preferably less than 1.2 times the diameter of the retaining member. Preferably said dimension is considered a guide means to guide movement of the retaining member and more particularly to ensure that the retaining member must cross a predetermined location (preferably a central location) when moving. Typically, the guide means may be a track or the like. Typically, the valve may be circular shaped and the guide means may comprise at least two intersecting paths. Thus for such embodiments the retaining member can essentially move in two dimensions when permitted, and typically when the actuator or valve is in the intermediate position.

Typically the release position of the retaining member is closer to a side wall of the housing than the retaining position. Preferably the retaining position is close to or substantially in the centre of the housing but is more preferably not exactly at the centre and so rotation in use, in the absence of any other forces, will cause the retaining member to move to the release position.

References to said two positions of the retaining member should be construed as two functional positions, that is, a retaining position and a release position. However, a plurality of different spatial positions may be provided, for example, typical embodiments have four spatial positions provided for the release position.

The housing also comprises upper and lower ends typically attached to the side walls, the upper end being the end which is typically closer to the obstructing member and to the surface of the borehole in use. Typically the rod of the obstructing member extends through the upper end.

Typically at least one of the upper and lower ends of the housing, has the guide means provided thereon for the retaining member, for example grooves to provide tracks for the retaining member. These are shaped to guide the retaining member such that it is remains on the tracks regardless of whether it is in the retaining or release position. Preferably the tracks are at right angles to each other and thus form a + or cross shape on the upper or lower end, typically the lower end.

When the obstructing member is in the downwards position, the retaining member cannot typically move from the release position into the retaining position. For example, in such a downwards position, preferably the position of the rod prevents the retaining member from moving from the side wall of the housing to the centre of the housing.

Preferably the valve has a second biasing mechanism to bias the retaining means to the retaining position. The second biasing mechanism may be the lower end shaped such that, in the absence of other forces, the retaining member will rest in the retaining position due to gravity. For example the lower end may be V shaped, concave or saucer shaped such that the centre of the lower end of the housing is vertically lower than the edges of the lower end of the housing.

Additionally, or alternatively, the second biasing mechanism preferably comprises a magnetic function. At least one of the retaining member, rod, upper end or lower end of the housing are preferably magnetised to bias, or further bias, the retaining means in the retaining position.

In preferred embodiments, the second biasing mechanism comprises the shape of the lower end and at least one magnetised component to bias the retaining member in or toward the retaining position.

Alternative embodiments may use other biasing mechanisms instead of or in addition to these described above. For example, the retaining member may have tensile or compressive springs so as to bias the retaining member in or toward the retaining position.

Thus, preferred embodiments of the present invention comprise a first biasing mechanism to bias the obstructing member in or towards the upwards position and a second biasing mechanism to bias the retaining member in or towards the retaining position.

Typically a chamber is defined between the upper end of the housing and the piston and typically the rod extends though said chamber. Normally the first biasing mechanism, such as a spring, is also provided in said chamber. Preferably a port is provided in said chamber in order to release the pressure therein. Preferably the port is vented to a pressure equalisation mechanism, the housing and/or to the outside of the valve.

Typically, seals are provided between the piston and the cylinder.

The valve of the present invention may be used to control a number of different downhole tools such as circulation subs, packers, non-rotating housings or the like.

According to a first aspect of the present invention there is provided a method of controlling an actuator, the method comprising:

providing an actuator according to the first aspect of the invention; and rotating the actuator such that a centrifugal force is imparted upon the retaining member sufficient to cause the retaining member to move from the retaining position to the release position, thereby permitting the obstructing member to move from the first position to the second position.

According to a second aspect of the present invention there is provided a method for controlling a valve, the method comprising:

providing a valve according to the second aspect of the invention;

rotating the valve to cause the obstructing member of the valve to move from the obstructing position or the open position to the other of the obstructing position and open position, directly or indirectly, by the centrifugal forces caused by said rotation.

Preferably, the actuator or valve is provided within an elongate member, such as a drill string.

Typically, the actuator or valve is operated downhole, that is, in a borehole. Thus the method typically also includes inserting the elongate member into a borehole.

Preferred or other optional features of the actuator or valve according to the first and second aspects of the invention are to be considered, independently, as preferred or optional respective features of the actuator when used according to the first aspect of the invention and of the valve when used according to the second aspect of the invention.

In particular preferably the valve used according to the second aspect of the invention has the retaining member described in respect of the first aspect of the invention.

Thus the rotation of the valve preferably urges the retaining member to move from one of its positions to the other, preferably from the retaining position to the release position.

Various forces act on the retaining member to urge it into the retaining position. These typically include magnetic attraction, the shape of a lower end, and the obstructing member being urged against the retaining member by the fluid flow.

The rotation of the actuator or valve needs to be of such a speed in order to overcome these forces. Thus typically the rotation is greater than 20 rpm, more preferably is in the range of between 20 rpm and 400 rpm although this can vary depending on the strength of the second biasing mechanism and other factors.

Thus to cause the obstructing member to move from one position to another, the rotational rate may merely be increased. Alternatively, or in addition, the fluid flow through the valve may be reduced to reduce the force urging the obstructing member onto the retaining member. This may be sufficient to release the retaining member from the retaining position without increasing the centrifugal force by increasing the rotation.

However preferably both are done—the rate of rotation is increased as well as the fluid flow rate being reduced. In any case, the retaining member is preferably moved from the retaining position to the release position and the obstructing member, still typically subject to force from the fluid flow, moves from the first or upwards position to the second or downwards position under action of the fluid flow, typically against the first biasing mechanism.

As noted earlier, the upward position of the obstructing member may correspond with either the obstructing position or the open position—this can vary from one embodiment to another. Normal operations may be conducted where the obstructing member is in one of the upward and downward positions and secondary operations may be conducted when the obstructing member is in the other of the upward and downward positions.

Thus the method according to the present invention allows the direction of fluid flow to be changed to allow secondary operations to be performed. For example, where the downwards position of the obstructing member corresponds with the open position, fluid is diverted to the second outlet for secondary operations, for example to activate the radial extension of blades to ream the borehole. So long as sufficient fluid flow is maintained to hold the obstructing member in the downward position, the retaining member typically cannot move back into the retaining position, since the obstructing member is typically taking up that space, and so at this stage, the rotational speed is not important for the operation of the valve.

When required, the valve can be controlled by an operator to move the obstructing member back to the upward position and so resume normal operations. To do this, the fluid flow is reduced so that the first biasing mechanism overcomes the force of the fluid flow and returns the obstructing member to the upwards position. The rotational speed of the valve may also then be reduced or stopped altogether, if required, to allow the secondary biasing mechanism to bias the retaining member into or toward the retaining position. When the retaining member is in such a retaining position, the fluid flow may be increased again so that the obstructing member is urged against the retaining member. Thereafter, rotation of the valve may be increased as required for the purposes of conducting the normal operations.

Fluid is typically circulated through the inlet and to at least one of the primary and secondary outlets of the valve. The fluid preferably urges the obstructing member towards the downward position. However this functions to urge the obstructing member, typically the rod, against the retaining member and so secures the retaining member in the retaining position and the obstructing member remains in the upward position.

The valve may be switched between the normal to the secondary operations as necessary.

The method may be used for a number of different purposes, such as well fracturing, coring and MWD activities especially for reaming.

BRIEF DESCRIPTION OF THE DRAWINGS

Embodiments of the present invention will now be described, by way of example only, and with reference to the accompanying figures in which.

DETAILED DESCRIPTION

Figure 1B:
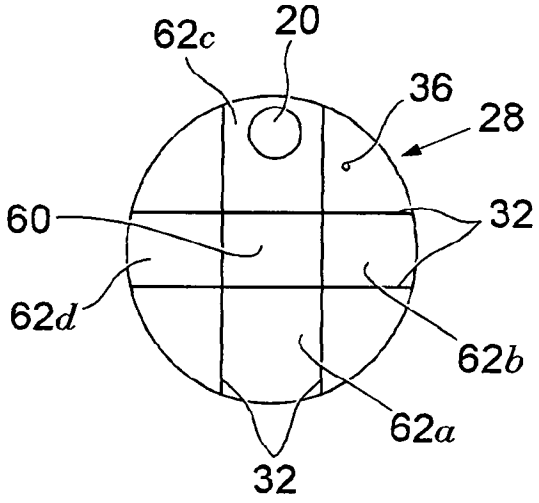
FIG. 1*b* is a plan view of a retaining member housing of the valve as shown in FIG. 3, in a first or downward, released position.
Figure 1A:
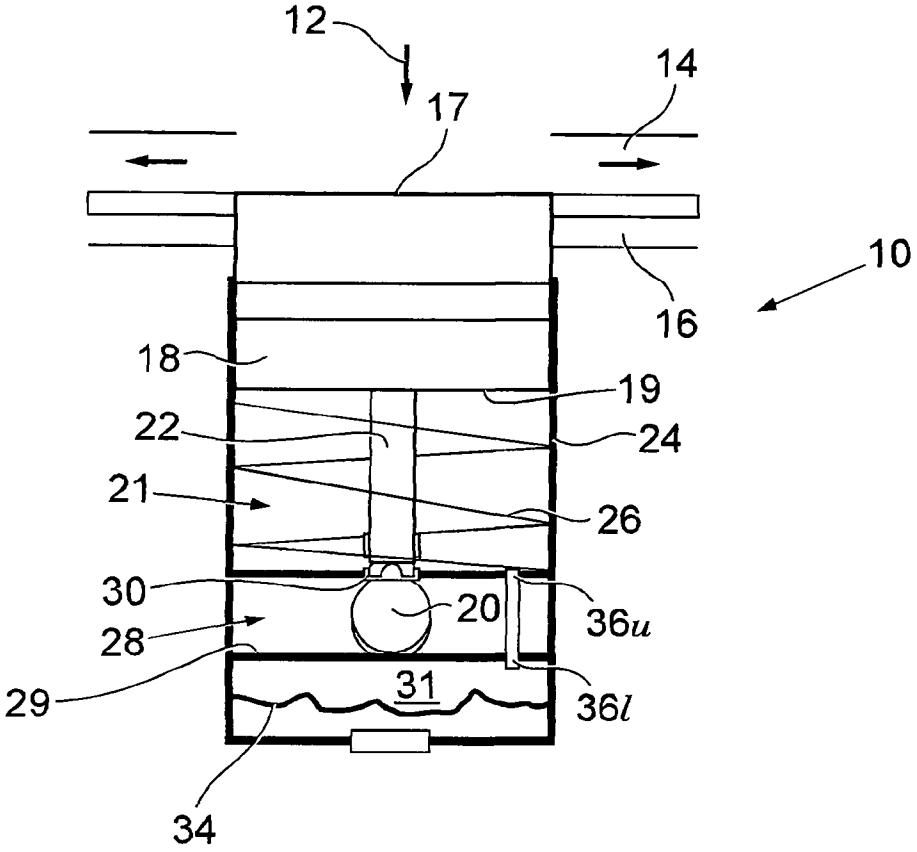
FIG. 1*a* is a front sectional view of an actuator in the form of a valve in accordance with the present invention, in an uppermost intermediate and unlocked position.

A first embodiment of an actuator in the form of a valve 10 in accordance with the present invention is shown in FIG. 1*a* and comprises a fluid inlet 12, a first fluid outlet 14, a second fluid outlet 16, a piston 18 telescopingly arranged within a cylinder 24 and sealed thereto, a ball housing 28 and a retaining member 20 in the form of a lock ball 20 provided in the housing 28.

The housing 28 comprises an upper end and a lower end 29. The upper end is approximately in the centre of which is formed an opening through which a rod 22 can pass as will be described.

The lowermost face of the piston 18, inner circumference of cylinder 24 and the upper end of housing 28 define a chamber 21. A rod 22 extends from the piston 18, through the chamber 21 and can, in certain configurations, extend into the housing 28 as will be subsequently described. At the end of the rod 22, a magnet 30 is provided.

The retaining member 20 is a steel lock ball, which can move around the housing 28 to a limited extent, when not locked in a retaining position 60 as will be detailed subsequently. As shown in FIG. 1*b*, the housing 28 has guide means or tracks 32 arranged in a + or cross formation and (when not locked/retained) the ball 20 can only move along these tracks 32 within the housing 28. Whilst not shown in the figures, a lower face 29 of the housing 28, upon which the ball 20 rests, has a slight 'saucer shape' or concave shape in order to slightly bias the ball 20 to the centre of the housing, which is also the intersection point of the tracks 32 and directly below the rod 22. The magnet 30 on the rod 22 also biases or attracts the ball 20 to this position, referred to as the 'retaining' position 60 where the piston 18 is typically in a relatively upwards direction; as shown in a locked configuration in FIG. 2 and an intermediate unlocked configuration in FIG. 1*a*. For this embodiment, this upward position also corresponds with the piston 18 obstructing and closing the second outlet 16.

The valve 10 comprises an oil reservoir 31 provided toward its lowermost end, immediately below the housing 28. The oil reservoir 31 has a flexible membrane 34 at its lowermost end, the outermost face of which is in fluid communication with downhole fluid. The chamber 21, interior of the housing 28 and reservoir 31, are all filled with suitable lubricating oil such as hydraulic oil, and the chamber 21 is in fluid communication with the interior of the housing 28 via an equalisation port 36U, and the interior of the housing 28 and the reservoir 31 are in fluid communication via an equalisation port 36L.

Accordingly, the flexible membrane 34 in use allows the chamber 21, the interior of housing 28 and oil reservoir 31 to be pressure equalised with the downhole fluid/hydrocarbon reservoir pressure.

The valve 10 can be used in a borehole for a number of downhole operations, specifically those that can provide rotation of an elongate member extending into the borehole, such as the drillstring and typically those which also permit fluid circulation. In the FIG. 1*a* embodiment, the valve 10 is provided as part of a drill string (not shown) having a drill bit at the lowermost end thereof which is rotated downhole in order to cut into a rock formation. Drilling fluids are circulated downhole to cool the drill bit and retrieve drill cuttings to the surface. The FIG. 1*a* embodiment also includes a reamer (not shown) in the drillstring for increasing the size of a drilled borehole.

Figure 2:
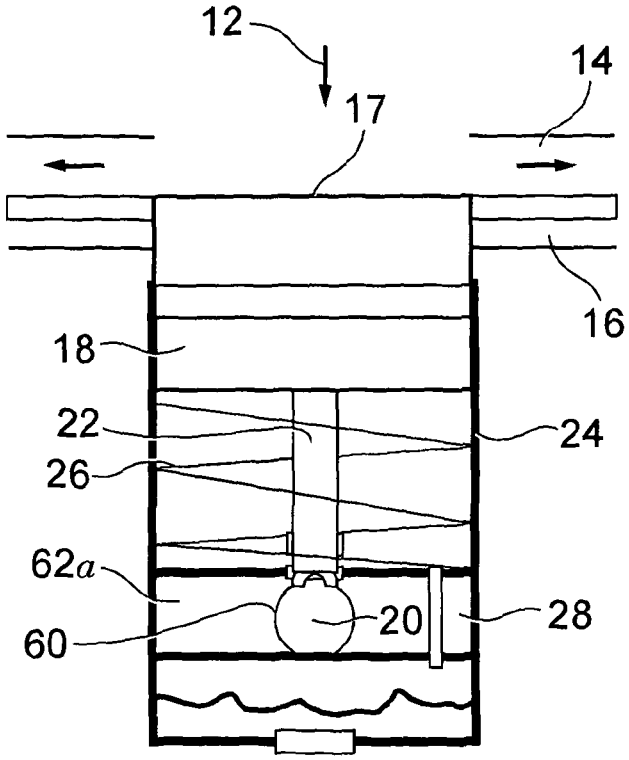
FIG. 2 is a front sectional view of the FIG. 1*a* valve, in a slightly different upward, restrained and locked position where a piston is restrained by a ball and vice versa.

Under normal operation, shown in FIG. 2, drilling fluid, sometimes called "drilling mud", is received in the inlet 12 from the throughbore of the drillstring, bears down on face 17 of the piston 18 and exits the valve through the first outlet 14 to the drill bit. The entire drill string (including the valve) is rotated so the drill bit can cut into the rock formation.

The piston 18 has a bearing face 17 arranged such that in use, fluid from the inlet 12 bears onto the face 17 and so urges the piston 18 in a 'downwards' direction towards the housing 28. Opposite the bearing face 17, the piston 18 has the rod 22 attached thereto and they move downwards together within the cylinder 24 against the biasing action of a spring 26. However, as shown in FIG. 2, the ball 20 prevents any further downwards movement of the rod 22 and piston 18 (whilst fluid bearing on the face 17 causes a higher downwardly directed force than the upwardly directed force of the spring 26) and thus, whilst the ball 20 is located in the central position 60, it retains the piston 18 in the position shown in FIG. 2.

Thus in use a number of conflicting forces are acting on the ball 20. The lower plate 29 and magnet 30 attract the ball to the central, retaining position 60, and importantly the fluid bearing on the face 17 of the piston 18 pushes the rod 22 onto the ball 20 and secures it in place in the retaining position 60, as shown in FIG. 2. However, if the rod 22 is not urged onto the ball 20 (as shown in FIG. 1*a*) then rotation of the valve 10 urges the ball 20 further off centre, away from the retaining position 60 towards release positions 62*a*-62*d* (shown in FIG. 1*b*), due to the resulting centrifugal force acting on the ball 20. During normal operation, the centrifugal forces caused by rotation of the valve 10 are insufficient to move the ball 20, especially since the rod 22 is firmly holding the ball 20 in the central retaining position 60. Thus the piston 18 remains in a relatively upward position (referred elsewhere as a first or locked position), obstructing the outlet 16 and so the fluid flow through the valve is from the inlet 12 to the first outlet 14 only, as shown in FIG. 2.

During the drilling operation it may be required to extend the blades (not shown) of the reamer and also direct drilling fluid thereto. To do this, the valve 10 is activated and fluid is directed out of the second outlet 16 by following the procedure described below.

Starting from the normal drilling configuration as shown in FIG. 2, the fluid flow rate into the valve 10 is reduced (or may even be stopped) by an operator (not shown), thus releasing the downward pressure on the piston 18 and thereby reducing or removing the grip of the rod 22 on the ball 20, such that the valve 10 is now in the intermediate position or configuration shown in FIG. 1*a*.

The valve 10 is then typically rotated at an increased rate by the operator, typically by rotating the drillstring. The relative magnitude of the forces acting on the ball 20, described above, have now changed and the centrifugal force is large enough to overcome the forces maintaining the ball 20 in the central retaining position—the ball 20 is thus moved, within the tracks 32, to the outside of the housing 28 as shown in FIG. 1*b* to one of the release positions 62*a*-62*d*.

Figure 3:
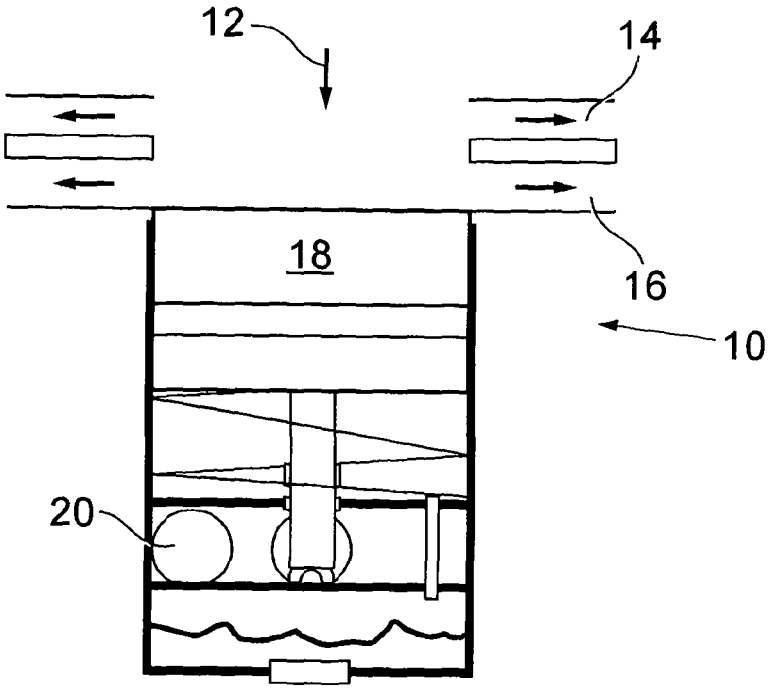
FIG. 3 is a front sectional view of the FIG. 1*a* valve, but in a second downward, released position.

Increased fluid flow by the operator from surface through the drill string and into the valve inlet 12 (which is then started if it was completely stopped) then presses the piston 18 down against action of the spring 26. Since the ball 20 is not present under the rod 22, the piston 18 and rod 22 both move down in the cylinder 24 and take up the second/downward/released/open position shown in FIG. 3 and thus open the outlet 16. Fluid may then flow from the inlet 12 through the outlet 16 to the reamer and activate it in the normal way. So long as the fluid flow is maintained at such a rate to maintain the piston 18 in a relatively downward, open, position, the rotation of the drill string and the valve 10 has no bearing on the operation of the valve 10, since the ball 20 cannot return to its retaining position since the rod 22 is taking up that space, as shown in FIGS. 1*b* and 3.

Thus the valve 10 can operate with the piston 18 in the relatively upwards obstructing position (i.e. the first position) to perform normal operations and then be switched by an operator to a mode where the piston 18 is in an open, relatively downward, position (i.e. the second position) to perform secondary operations.

Such embodiments provide a convenient way to activate a reamer tool, or conduct other downhole operations.

A particular benefit of embodiments of the invention is that the operation of the valve may be reversed and thereafter repeatedly cycled downhole, and such an operation will now be described.

With the valve 10 in the configuration shown in FIGS. 1*b* and 3, the fluid flow into the valve 10 is (again) reduced or stopped by the operator in order to allow the biasing action of the spring 26 to overcome any force exerted on the piston 18 by any remaining fluid flow. The piston 18 then returns to its relatively upward obstructing position and so closes the second outlet 16 so that the reamer is no longer activated. Typically the reamer will be biased to its closed position by a spring or the like (not shown) and so the blades of the reamer will then be retracted.

The rotation of the valve 10 is slowed and the various biasing means which can be any one of or a combination of the concave shaped lower face 29, gravity and/or the magnet 30 urge the ball 20 to its central retaining position 60, which is no longer taken up by the rod 22, since the rod 22 has been retracted with the piston 18. The combination of the slow rotation of the valve 10 and the tracks 32 ensure that the ball 20 must move to the central retaining position 60 no matter what angle of deviation experienced by the drillstring and thus the valve 10. When the ball 20 has returned to position 60 and is kept there by the magnetic attraction force from the magnet 30, the flow through the valve may be increased or started again in order to have the rod 22 press against the ball 20 and hold it in the locking position shown in FIG. 2.

The piston 18 is then held in the upward position and the valve 10 may then be rotated again at an increased speed, and fluid directed through the valve 10 to allow normal drilling operations (without under-reaming) to continue.

Thus the valve 10 of certain embodiments of the invention may be switched from one mode to another mode, for example on and off, and back to the first mode as required. For example the valve 10 may be switched from only directing fluid to the outlet 14, to directing fluid to both outlets 14 and 16, and then only to outlet 14 again and can continue to be switched between these two modes as necessary. In contrast, known valves for such operations may only be switched a limited number of times, such as once or twice.

It will be appreciated that a number of different configurations of inlet and outlets may be possible for different embodiments of the present invention, depending on the particular requirement where the valve of the present invention is to be used.

Figure 4B:
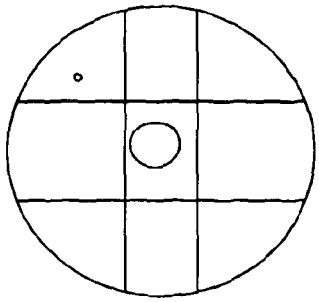
FIG. 4*b* is a plan view of a retaining member housing of the FIG. 4*a* valve, in the upward (restrained) position.
Figure 4A:
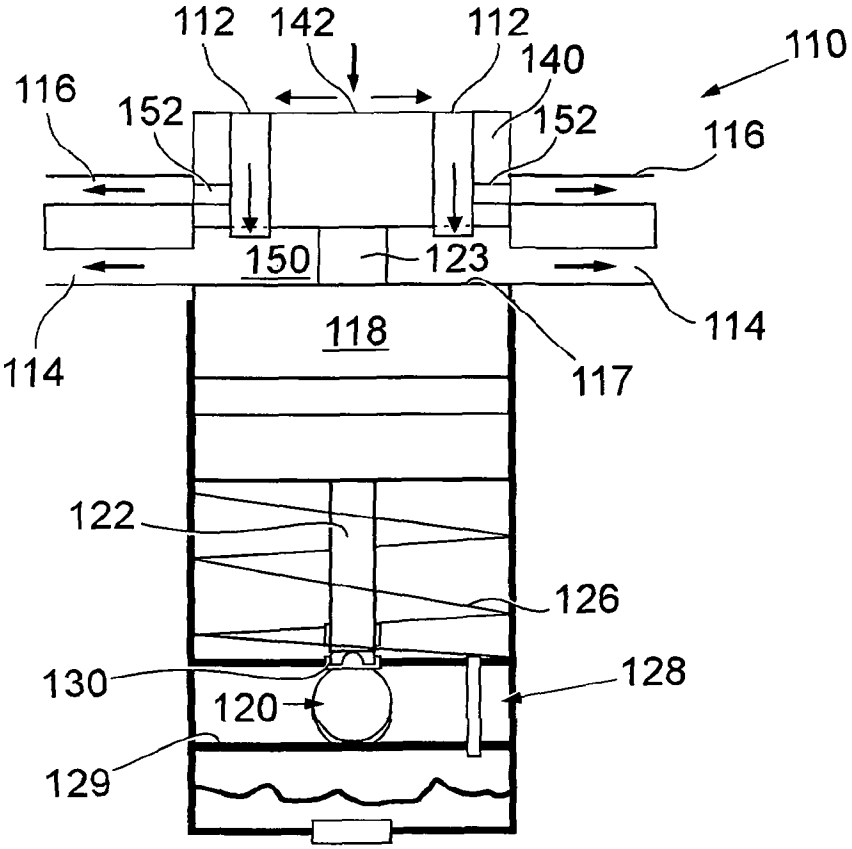
FIG. 4*a* is a front sectional view of a second embodiment of an actuator in the form of a valve in accordance with the present invention, in an upward, restrained position.

One alternative configuration is a valve 110 shown in FIG. 4*a*. In the FIG. 4*a* embodiment, the retaining/upward piston position corresponds to the open position (unlike the previous embodiment) and the release/downward piston position is the obstructing position, that is the opposite of the FIG. 1*a* embodiment. This allows normal operations to be conducted when the piston 118 is in the relatively downward position, and the secondary operations to be conducted when the piston 118 of the valve 110 is in an upward position, opposite of the FIG. 1*a* embodiment.

Like parts are labelled with corresponding numbers for the FIG. 1*a* embodiment except preceded by a '1'.

The valve 110 comprises a valve block 140 connected to the piston 118 via a rod 123 at the fluid input side. The rod 123 spaces the valve block 140 away from the piston 118 and so there is defined a chamber 150 between an upper face 117 of the piston 118, and the valve block 140. The chamber 150 is in communication with the first outlet 114 (used for normal operations such as directing drilling fluid to the drill bit).

The fluid input 112 extends through the valve block 140 and connects to the chamber 150. The valve block 140 also has porting 152 for selective communication with the second outlet 116, used for secondary operations such as diverting a proportion of the drilling fluid along an alternative flow path to e.g. an under-reamer.

Other components are the same as those described for the FIG. 1 embodiment.

Thus as shown in FIG. 4*a*, the piston 118 of the valve 110 is in the relatively upward, open position and secondary operations are performed in this position for the FIG. 4*a* embodiment since the porting 152 is aligned with the second outlet 116. Thus the fluid input 112 is directed to both of the outlets 114, 116.

Figure 5B:
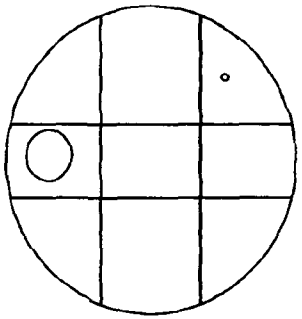
FIG. 5*b* is a plan view of a retaining member housing of FIG. 5*a*, in the downward (released) position.
Figure 5A:
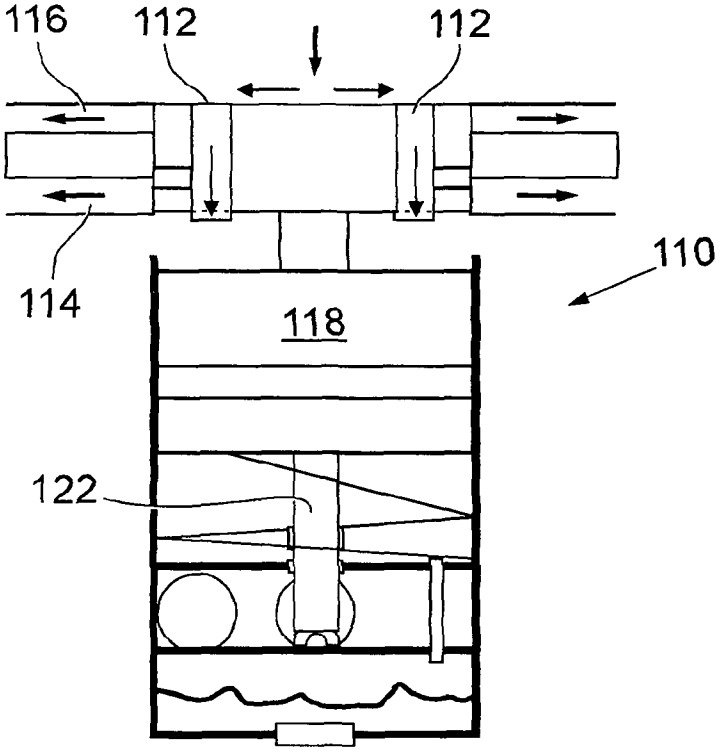
FIG. 5*a* is a front sectional view of the FIG. 4*a* embodiment of a valve, in the downward (released) position.

The valve 110 may be activated to move the piston 118 from the upwards position shown in FIGS. 4*a* and 4*b* to the downwards position shown in FIGS. 5*a* and 5*b* in the same way as that described for the FIG. 1*a* embodiment—the only difference being that this movement of the valve 110 closes the connection between the inlet 112 and the second outlet 116 rather than open an outlet, as was the case with the first embodiment.

Thus, the valve 110 is activated by reducing fluid flow from surface, which results in reducing pressure on a bearing face 142 of the valve block 140 which results in the spring 126 moving the piston 118 upwards slightly and therefore reducing the hold on a ball 120 held by a rod 122. The rotation of the valve 110 is increased and the ball 120 is moved under centrifugal force away from underneath the rod 122. The fluid flow is then increased at surface and pressure from the flow of fluid bearing onto the face 142 pushes the valve block 142, rod 123, piston 118 and rod 122 downwards, thus breaking the connection between the porting 152 and the second outlet 116.

Normal operations may then ensue, such that the fluid flowing into the fluid inlet 112 flows only to the first outlet 114, for example only to a drill bit and not to a reamer.

To revert back to the upwards position, the process for the embodiment of valve 110 is also essentially the same as that described for the earlier embodiment of valve 10: the fluid flow is reduced causing spring 126 to move the piston 118 along with rod 123 and valve block 140 thereabove, and the rod 122 therebelow, upwards. This realigns the connection between the port 152 and the second outlet 116. The ball 120 is urged back into place by appropriate (relatively slow) rotation of the valve 110 and the various biasing means, namely the magnet 130 and the shape of the lower wall 129 and the guide means 132. Fluid flow is thereafter increased which serves to hold the ball 120 in the retaining position and the piston 118 in the upward position.

Thus fluid flow downhole may be manipulated and embodiments of the present invention can also be designed such that their default position is to direct fluid for secondary operations.

An advantage of the second embodiment of valve 110 is that in the event of a failure of the spring 126, the piston 118 will revert to its downwards position and only direct fluid to the drill bit, not to the reamer. The valve 110 can thereafter be recovered through the upper narrower section of the borehole since the reamer is inactivated.

It should however be noted that the centre location 60 for the ball 20 is preferably not the exact centre of the longitudinal axis of the actuator/valve 10, 110 because, if it were the exact centre, the centrifugal force would not act on the ball to move it off the centre during rotation of the actuator/valve 10, 110. Therefore the location 60 for the ball 20 is more preferably slightly off the exact centre of the longitudinal axis of the actuator/valve 10, 110 such that rotation of the actuator/valve 10, 110 causes a centrifugal force to act on the ball 20 to move it further away from the location 60 (when the rod 22,122 is not in the locked configuration shown respectively in FIGS. 2 and 4*a*). Alternatively, or additionally, a ramp, wedge, catch or other suitable type of mover or pusher could be used to move or push the ball 20 off or away from the very centre location 60 when the actuator/valve 10, 110 moves from the locked configuration of respectively FIG. 2 or 4*a* to the intermediate unlocked configuration of FIG. 1*a* such that rotation of the actuator/valve 10, 110 causes a centrifugal force to act on the ball 20 to move it further away from the location 60.

Figure 6:
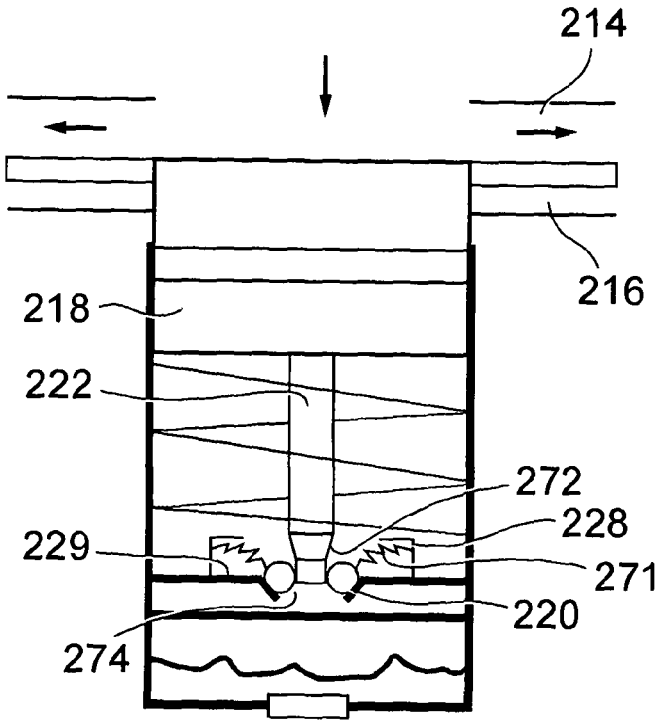
FIG. 6 is a front sectional view of a third embodiment of an actuator in the form of a valve in accordance with the present invention, in a restrained and locked position.
Figure 7:
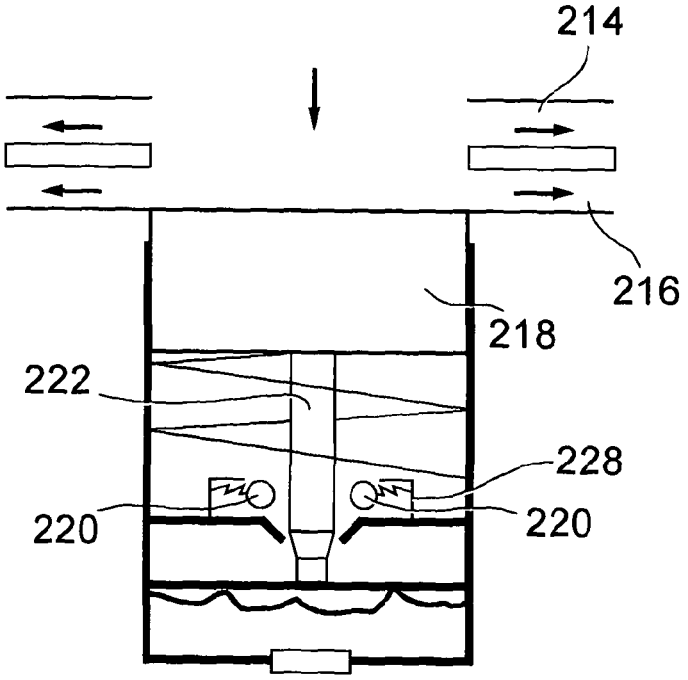
FIG. 7 is a front sectional view of the FIG. 6 valve, but in a second downward, released position.

A third embodiment 210 is shown in FIGS. 6 and 7 with like parts labelled with corresponding numbers for the FIG. 1*a* embodiment except preceded by a '2'. The third embodiment 210 has a similar configuration to the FIG. 1 embodiment in that the retaining/upward position corresponds to a closed valve position. However in the third embodiment a pair of retaining members 220 are each biased towards the centre of the housing 228 by compression springs 271 extending from the top corner of the housing 228. The rod 222 tapers towards its lower end, thus providing an angled abutting face 272 for abutment with the retaining members 220 (which are shown in the figure as balls but can be a variety of other shapes) in a retaining position.

Thus in this retaining/upward/closed position shown in FIG. 6, the retaining members 220 are held between the abutting face 272 of the rod 222 and a dimple 274 provided in a lower floor 229 of the housing 228.

The third embodiment works using the same principle as that described for the first embodiment: fluid acts on a bearing face 217 of a piston 218 which presses the attached rod 222 onto the retaining members 220 thus holding the valve in the closed position (blocking outlet 216), allowing the fluid flow through the outlet 214 towards a drill bit (not shown).

To switch the actuator to the open position shown in FIG. 7, fluid flow is reduced to release the retaining members 220, then the centrifugal forces will cause the retaining members 220 to move towards the edge of the housing 228 away from the retaining position between the rod 222 and the dimple 224, against the bias of the springs 271. (The speed of rotation of the actuator may be increased to increase the centrifugal forces if necessary.) The fluid flow is then increased to cause the piston and associated rod 222 to move down though an aperture 274 in the dimple 224 and thus open the outlet 216; as shown in FIG. 7.

Figure 8:
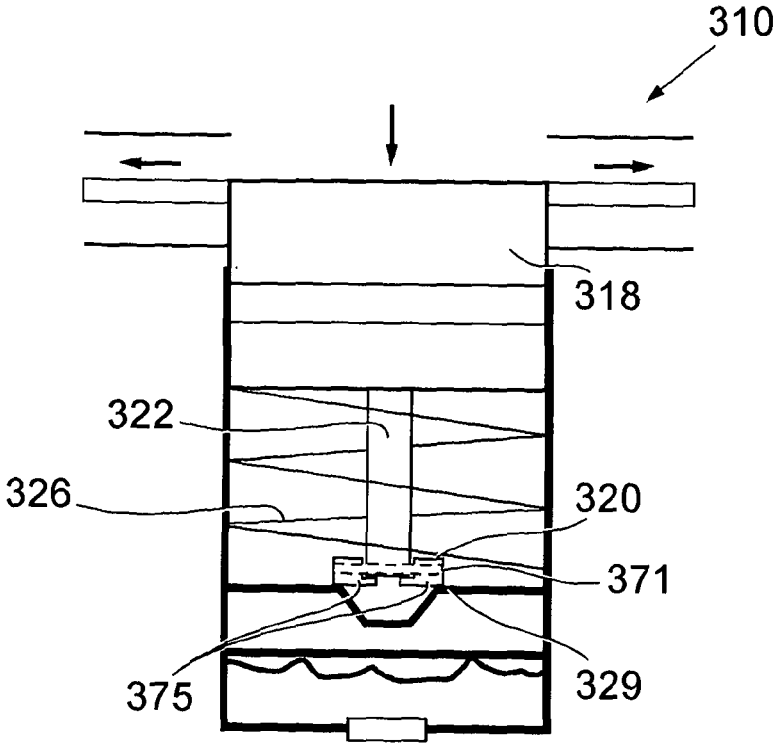
FIG. 8 is a front sectional view of a fourth embodiment of an actuator in the form of a valve in accordance with the present invention, in a restrained and locked position.
Figure 9:
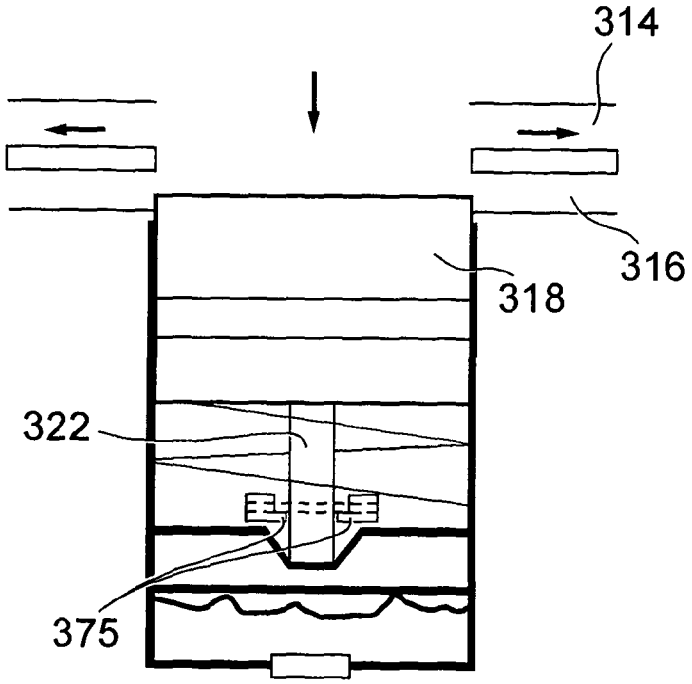
FIG. 9 is a front sectional view of the FIG. 8 valve, but in a second downward, released position.

A further modification of the retainer member is shown in a fourth embodiment in FIGS. 8 and 9 with like parts numbered in line with the previous embodiments except preceded by a '3'. The retaining member in the third embodiment is a pair of semicircular plates 320, having an inwardly extending circumferential lip 375 extending below the rod 322 and above the lower wall 329, thus holding the piston 318 in the retaining/upward position corresponding to a closed valve position. A tensile garter spring 371 biases the plates 320 inwardly towards this position. Release of the lips 375 by a drop in the fluid flow, movement of the plates outwards by rotation of the actuator 310, and then an increase in fluid flow causing the rod 322 to be pushed down through an aperture 374 against action of a spring 326; all as described for earlier embodiments, changes the configuration to open the outlet 316, as shown in FIG. 9.

Figure 10:
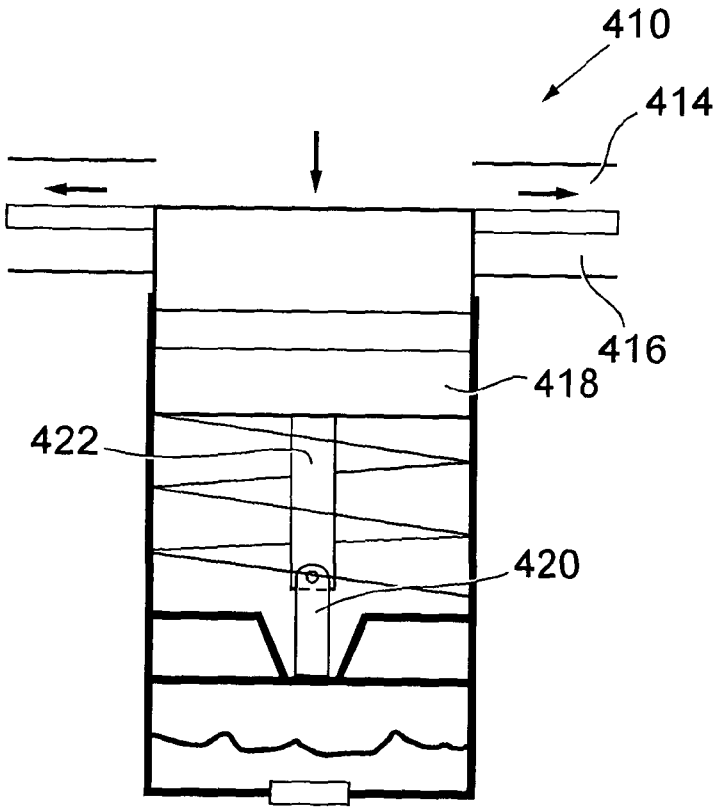
FIG. 10 is a front sectional view of a fifth embodiment of an actuator in the form of a valve in accordance with the present invention, in a restrained and locked position.
Figure 11:
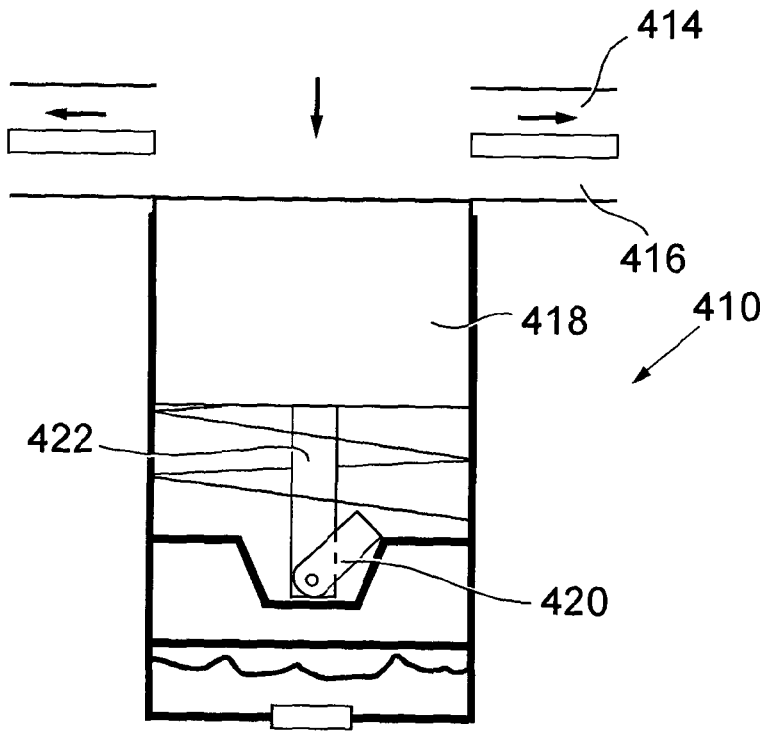
FIG. 11 is a front sectional view of the FIG. 10 valve, but in a second downward, released position.

In a fifth embodiment shown in FIGS. 10 and 11 a retaining member is provided in the form of a lever 320, pivotally mounted on the end of the rod 422. Centrifugal forces caused by rotation of the actuator 410 can also cause the lever 420 it to move outwards and thus allow the piston 418 to move downwards and open the outlet 416 towards a reamer following the same procedure described for earlier embodiments.

Improvements and modifications may be made to the embodiments described herein without departing from the scope of the invention. For example, the valve may be designed to close the first outlet completely when the second outlet is opened.

Furthermore, the flow path to the drill bit could be modified to pass straight through or along the longitudinal axis of either of the actuator/valves 10, 110 through fluid carrying channels, conduits or the like and such modified actuator/valves have the advantage that they can be readily retrofitted into conventional drill strings. In such modified embodiments, the valve piston blocks 18; 140, 118 would be modified to not take up the entire throughbore but instead would only take up a portion of the throughbore (for instance by having a cross shape) and fluid channels would pass the fluid therethrough but the cross shape of the valve piston blocks 18; 140, 118 would still present a surface against which the fluid would act against to push the valve piston blocks 18; 140, 118 in the downwards direction.

Furthermore, the magnet 30 may not be required if the ball 20 was magnetic instead. Alternatively, the magnet 30 may be placed at the central retaining position 60 within the lower face 29.

Alternatively, or in addition, for any embodiment described herein the magnet 30 could be replaced by or supplemented by a further biasing means such as a spring means in the form of spring(s) (similar to those included in the third embodiment) or an elastic band (similar to the fourth embodiment) which acts between the housing 28 and the ball 20 in order to attract the ball 20 toward the centre 60 of the housing 28.

Furthermore, the valves 10, 110 described herein could, with suitable modification, be used in many other applications (whether downhole or otherwise) that require actuation of a mechanism or circuit where rotation is available such as measurement whilst drilling (MWD), well fracturing, reservoir coring and operating circulating subs used in other applications such as wellbore clean up etc.

The invention claimed is:

1. A downhole actuator for a downhole drill string in a borehole of an oil or gas well, the downhole actuator comprising:

a housing;

an obstructing member moveable between a first position and a second position;

a retaining member moveable in the housing between a retaining position which retains the obstructing member in the first position;

a release position which does not retain the obstructing member in the first position and/or allows or causes the obstructing member to move to the second position;

wherein the retaining member is adapted to move in use, from one of the retaining position and release position to another of the retaining position and release position, at least in part, by centrifugal forces; and wherein an entire drill string is rotated in the borehole and the centrifugal forces are caused by the rotation of the drill string in the borehole.

2. The downhole actuator as claimed in claim 1, wherein the retaining member moves radially in the housing relative to the obstructing member into the release position, which release position is spaced further away from an axis of rotation of the drill string than the retaining position.

3. The downhole actuator as claimed in claim 1, wherein the obstructing member is arranged such that, in use, fluid flow urges the obstructing member to move relative to the retaining member, in a direction towards the retaining member.

4. The downhole actuator as claimed in claim 1, comprising a first biasing mechanism to bias the obstructing member relative to the retaining member, in a direction away from the retaining member.

5. The downhole actuator as claimed in claim 4, wherein the first biasing mechanism comprises a spring or tensile mechanism.

6. The downhole actuator as claimed in claim 4, comprising a second biasing mechanism to bias the retaining member to the retaining position.

7. The downhole actuator as claimed in claim 6, wherein the second biasing mechanism comprises a wall of the housing shaped such that, in an absence of other forces, the retaining member will rest in the retaining position due to gravity.

8. The downhole actuator as claimed in claim 6, wherein the second biasing mechanism comprises a spring or tensile mechanism which biases the retaining member to the retaining position.

9. The downhole actuator as claimed in claim 6, wherein the second biasing mechanism comprises a magnetic component to bias the retaining member in the retaining position.

10. The downhole actuator as claimed in claim 1, wherein the actuator is arranged such that fluid flow urges the obstructing member in a first direction, and comprising a first biasing mechanism urging the obstructing member in a second direction, the first and second directions being opposite each other.

11. The downhole actuator in use, as claimed in claim 1, wherein a portion of the retaining member contacts a portion of the obstructing member in order to retain the obstructing member in one of its two positions, preferably said one of two positions being the retaining position.

12. The downhole actuator as claimed in claim 1, wherein the obstructing member comprises a piston provided in a cylinder.

13. The downhole actuator as claimed in claim 12, wherein the obstructing member comprises a rod rigidly attached to the piston.

14. The downhole actuator as claimed in claim 1, wherein:

the housing has a central aperture;

a portion of the obstructing member extends through the central aperture; and the obstructing member is supported in the central aperture by the retaining member when the retaining member is disposed in the retaining position.

15. The downhole actuator as claimed in claim 14, wherein the retaining position is off-centre of the housing and is not aligned with an axis of rotation of the drill string, wherein rotation of the drill string in use, in an absence of any other forces, causes radial movement of the retaining member into the release position.

16. The downhole actuator as claimed in claim 14, wherein the release position of the retaining member is closer to a side wall of the housing than the retaining position.

17. The downhole actuator as claimed in claim 1, wherein the housing comprises an upper wall and a lower wall and wherein at least one of the upper and lower walls of the housing has guide means provided thereon for guiding the movement of the retaining member between the retaining and release positions.

18. The downhole actuator as claimed in claim 1, wherein the retaining member comprises a ball.

19. The downhole actuator as claimed in claim 1, wherein the retaining member comprises a lever pivotally mounted on the obstructing member.

20. The downhole actuator as claimed in claim 1, wherein when the retaining member has moved from the retaining position to the release position and the obstructing member has moved from the first position into the second position, the retaining member cannot move from the release position into the retaining position.

21. A downhole valve comprising a downhole actuator as claimed in claim 1 and an inlet and an outlet.

22. The downhole valve as claimed in claim 21, wherein the first position of the obstructing member is an obstructing position which obstructs at least one of the inlet and the outlet and the second position of the obstructing member is an open position where the obstruction of at least one of the inlet and the outlet is removed.

23. The downhole valve as claimed in claim 21, wherein the obstructing member obstructs, at least partially, the outlet.

24. The downhole valve as claimed in claim 21, comprising a primary and a secondary outlet and the obstructing member in the obstructing position obstructs only the secondary outlet.

25. A method of controlling a downhole actuator in a drill string in a borehole of an oil or gas well, the method comprising:

providing a downhole actuator as claimed in claim 1; and applying a centrifugal force upon the retaining member by rotating the drill string as a whole to cause the retaining member to move from the retaining position to the release position, thereby permitting the obstructing member to move from the first position to the second position.

26. The method as claimed in claim 25, wherein a reamer is activated by the actuator, and the method comprises reaming a portion of a geological formation.

27. The method as claimed in claim 25, comprising reducing fluid flow into the borehole to encourage the retaining member to move from the retaining position to the release position.

28. The method as claimed in claim 25, comprising reducing fluid flow into the borehole to allow a primary biasing mechanism to move the obstructing member towards the first position.

29. The method as claimed in claim 28, comprising reducing the rotational speed of the actuator to allow a secondary biasing mechanism to bias the retaining member into or toward the retaining position.

30. The method as claimed in claim 29, comprising reducing fluid flow into the borehole to allow a secondary biasing mechanism to bias the retaining member into or toward the retaining position.

31. The method as claimed in claim 30, comprising increasing the fluid flow to urge the obstructing member against the retaining member.

32. A downhole valve for inclusion in a downhole drill string in a borehole of an oil and gas well, the downhole valve comprising:

an inlet and an outlet;

an obstructing member moveable between an obstructing position which obstructs at least one of the inlet and the outlet;

an open position where the obstruction of at least one of the inlet and the outlet is removed, wherein the obstructing member is adapted to move in use between the obstructing position and the open position, at least in part, by centrifugal forces caused by rotation of the entire downhole drill string in the borehole; and a retaining member moveable between a retaining position which retains the obstructing member in one of the obstructing position and the open position and a release position which does not retain the obstructing member in the position, wherein the retaining member is adapted to move in use, from the retaining position or the release position to the other of the retaining position and the release position, at least in part, directly by the centrifugal forces.

33. The downhole valve as claimed in claim 32, wherein the centrifugal forces act directly on the retaining member to move it from one of said positions to another.

34. A method for controlling a downhole valve included in a downhole drill string, the method comprising:

providing a downhole valve comprising:

an inlet and an outlet;

an obstructing member moveable between an obstructing position which obstructs at least one of the inlet and the outlet and an open position where the obstruction of at least one of the inlet and the outlet is removed;

a retaining member moveable between a retaining position which retains the obstructing member in one of the obstructing position and the open position and a release position which does not retain the obstructing member in the position; and rotating the downhole drill string and thereby rotating the downhole valve to cause the obstructing member of the downhole valve to move from the obstructing position or the open position to another of the obstructing position and open position, by the centrifugal forces caused by said rotation and to cause the retaining member to move from the retaining position or the release position to the other of the retaining position and the release position, at least in part, directly by the centrifugal forces.

* * * * *